US011047147B2

(12) United States Patent
Arlund et al.

(10) Patent No.: US 11,047,147 B2
(45) Date of Patent: Jun. 29, 2021

(54) L-SHAPED CROSSARM, RELATED SYSTEM, AND METHOD OF ASSEMBLY

(71) Applicant: MacLean Power L.L.C., Fort Mill, SC (US)

(72) Inventors: Joshua Arlund, Rockhill, SC (US); Douglas Moore, Charlotte, NC (US); Philip Rollins, Newberry, SC (US); Luke Frederickson, Chapin, SC (US); Tyler Krohn, Charlotte, NC (US); Jared Pratt, Irmo, SC (US)

(73) Assignee: MACLEAN POWER, LLC, Fort Mill, SC (US)

( * ) Notice: Subject to any disclaimer, the term of this patent is extended or adjusted under 35 U.S.C. 154(b) by 0 days.

(21) Appl. No.: 15/953,136

(22) Filed: Apr. 13, 2018

(65) Prior Publication Data

US 2018/0328070 A1 Nov. 15, 2018

Related U.S. Application Data

(60) Provisional application No. 62/506,113, filed on May 15, 2017.

(51) Int. Cl.
*E04H 12/24* (2006.01)

(52) U.S. Cl.
CPC ..... *E04H 12/24* (2013.01)

(58) Field of Classification Search
CPC ..... B29C 65/565
USPC ..... 428/57
See application file for complete search history.

(56) References Cited

U.S. PATENT DOCUMENTS

| | | | |
|---|---|---|---|
| 3,013,584 | A | 12/1961 | Reed et al. |
| 4,020,202 | A | 4/1977 | Kreft |
| 4,022,864 | A | 5/1977 | Medler |
| 4,262,047 | A | 4/1981 | Barnett et al. |
| 4,512,835 | A | 4/1985 | Gardiner |
| 4,728,749 | A | 3/1988 | Knight |
| 5,505,036 | A | 4/1996 | Wiles |
| 5,605,017 | A | 2/1997 | Fingerson et al. |

(Continued)

FOREIGN PATENT DOCUMENTS

| | | |
|---|---|---|
| CN | 204497696 U | 2/1997 |
| CN | 2610017 | 4/2004 |

(Continued)

OTHER PUBLICATIONS

International Search Report of PCT/US2018/032256 dated Jul. 27, 2018, 2 pages.

(Continued)

*Primary Examiner* — Brent T O'Hern
(74) *Attorney, Agent, or Firm* — Brooks Kushman P.C.

(57) ABSTRACT

The present disclosure relates to a mounting base for a crossarm and the crossarm. The mounting base may include a front-facing fastening surface, a rear-facing surface, and an opening formed between the front-facing fastening surface and the rear-facing surface, where the opening comprises a generally reverse L-Shaped geometry that extends through an entire width of the mounting base. The crossarm may include a first section and a second section that are oriented perpendicularly to each other, where the first section and second section are composed of composite material that contains a plurality of fibers within the composite material.

20 Claims, 5 Drawing Sheets

(56) References Cited

U.S. PATENT DOCUMENTS

| | | | | |
|---|---|---|---|---|
| 2010/0080952 | A1* | 4/2010 | Suzuki | B29B 11/16<br>428/113 |
| 2012/0048613 | A1 | 3/2012 | Lockhart et al. | |

FOREIGN PATENT DOCUMENTS

| | | | |
|---|---|---|---|
| CN | 204357185 | U | 5/2015 |
| GB | 917347 | A | 2/1963 |

OTHER PUBLICATIONS

International Preliminary Report on Patentability of PCT/US2018/032256 dated Nov. 19, 2019, 6 pages.
Written Opinion of PCT/US2018/032256 dated Jul. 27, 2018, 5 pages.
Office Action of Chinese Application No. 201880032067.X dated Aug. 3, 2020, 10 pages.
First Examination Report of Indian Application No. 201917045979, dated Oct. 13, 2020, 6 pages.
Extended European Search Report of EP 18802045.7 dated Jan. 11, 2021, 8 pages.

* cited by examiner

L-SHAPED CROSSARM, RELATED SYSTEM, AND METHOD OF ASSEMBLY

RELATED APPLICATIONS

The present patent document claims the benefit of the filing date under 35 U.S.C. § 119(e) of Provisional U.S. Patent Application Ser. No. 62/506,113, filed May 15, 2017, which is hereby incorporated by reference.

TECHNICAL FIELD

The present disclosure generally relates to a crossarm used in power transmission systems, systems including a crossarm, and methods of assembly.

BACKGROUND

Power transmission systems often include above-ground utility poles for suspending electrical power lines. The utility poles are traditionally made from wood, steel, or concrete. When multiple power lines or other related components are supported, a utility pole may include a horizontal crossarm and a crossarm bracket. Crossarms are typically formed of wood, steel, or polymer materials (e.g., plastic or fiberglass), and may be secured to the utility pole through a variety of hardware components. The crossarm may provide support for one or more suspended power lines. For example, the crossarm may be secured to a ceramic or polymer insulator that attaches directly to a suspended power line.

Over time, wood crossarms may deteriorate and rot due to weather, thereby decreasing the strength of the wooden crossarm and necessitating replacement. A wooden crossarm can absorb moisture and become a poor electrical insulator. As such, there is a risk of electricity traveling through the wooden crossarm, which can pose a risk of electrocution to a line technician. Additionally, wooden crossarms can suffer from variations in strength do to inherent flaws within the wood.

Exposure of steel crossarms to the weather elements can cause corrosion, and therefore may also present their own robustness problems. Additionally, steel crossarms lack electrical insulating properties that are desirable for electrical power applications.

In some instances, crossarms are formed of a hollow tube. Unless the cavity of the hollow tube is filled with some type of material or otherwise closed off, birds, animals, and insects may inhabit the cavity, causing damage to certain components, presenting safety concerns, and/or interfering with maintenance operations. A non-filled or sealed hollow tube may also retain moisture, which may degrade the crossarm over time or promote electrical activity.

DETAILED DESCRIPTION

Figure 1:
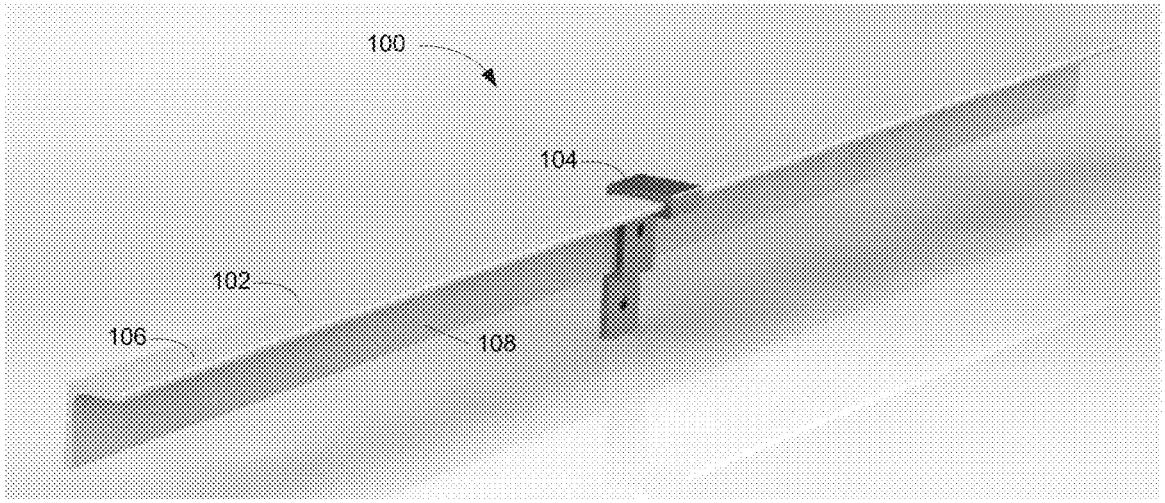
FIG. 1 is perspective view of a system with a crossarm and a mounting base in accordance with the present disclosure.

Various aspects are described below with reference to the drawings, and several of the elements are identified by numerals. The relationship and functioning of the various elements may better be understood by reference to the following description. However, aspects are not limited to those illustrated in the drawings or explicitly described below. The drawings are not necessarily to scale, and in certain instances, details may have been omitted that are not necessary for an understanding of aspects disclosed herein.

In this application, the use of the disjunctive is intended to include the conjunctive. The use of definite or indefinite articles is not intended to indicate cardinality. In particular, a reference to "the" object or "a or an" object is intended to denote also one of a possible plurality of such objects.

Figure 9:
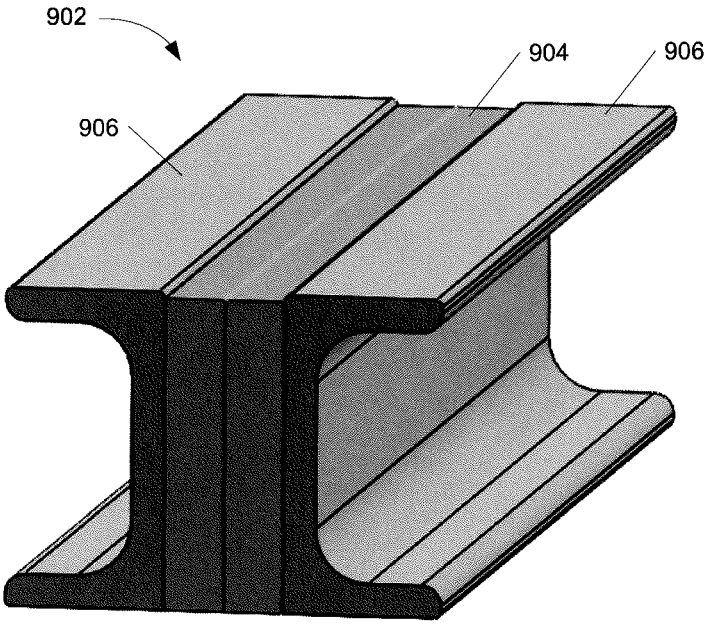
FIG. 9 is a perspective view of a crossarm in accordance with the present disclosure.

FIG. 1 is a perspective view of a system 100 with crossarm 102 and mounting base 104. In some non-limiting exemplary embodiments, the crossarm 102 may have a generally L-Shaped cross-section such that a first section 106 and a second section 108 may be generally perpendicular to one-another. Additional embodiments may generally take the shape of other rigid structural member profiles, such as an I-beam (as shown in FIG. 9) or a T-beam. As shown in FIG. 1, the first section 106 may extend away from the second section 108. Although FIG. 1 illustrates the second section 108 pointing in a generally downward direction (e.g., a generally reversed L-Shaped geometry), it is contemplated that, depending on the mounting location, crossarm 102 could be rotated such that the second section 108 is pointing in a generally upward direction (e.g., generally L-Shaped geometry).

Figure 2:
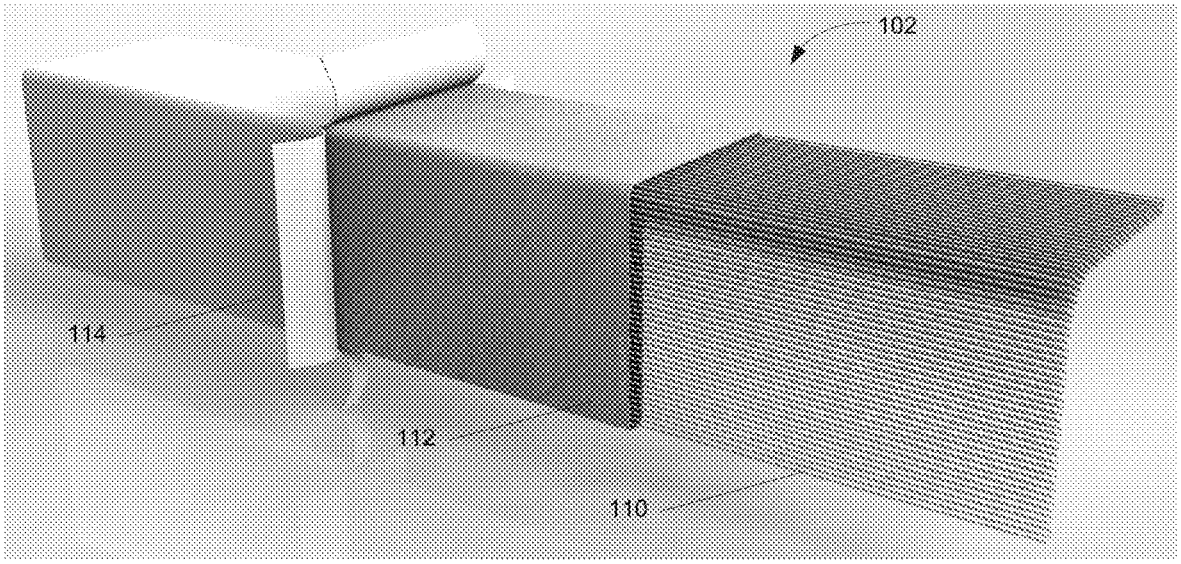
FIG. 2 is a cut-away interior view of a crossarm in accordance with the present disclosure.

Crossarm 102 may be extruded, fabricated, or formed from a composite material having a generally uniform cross-section extending in a longitudinal direction. In some embodiments, the composite material may be a reinforced plastic formed by drawing resin-coated glass fibers through a heated die, such as a pultruded fiberglass. FIG. 2 shows a cut-away interior view of a crossarm 102 with fibers 110 that are located within a material 112, such as a plastic for example. An outer coating 114 may cover the material 112 for added protection and/or strength. The crossarm 102 may be continuously fiber reinforced, such that fibers 110 extend the length of the crossarm 102, as shown in FIG. 2 for example. The length the fibers 110 extend can be any dimension of the crossarm 102, such as a longitudinal length or a transverse length. Alternatively, the crossarm 102 may be discontinuously fiber reinforced, such that fiber 110 do not extend the length of the crossarm 102. The length of fibers 110 in discontinuously fiber reinforced crossarms may vary from several inches to less than a millimeter. Fibers 110 in discontinuously fiber reinforced crossarms may, for example, be composed of chopped glass.

Figure 3:
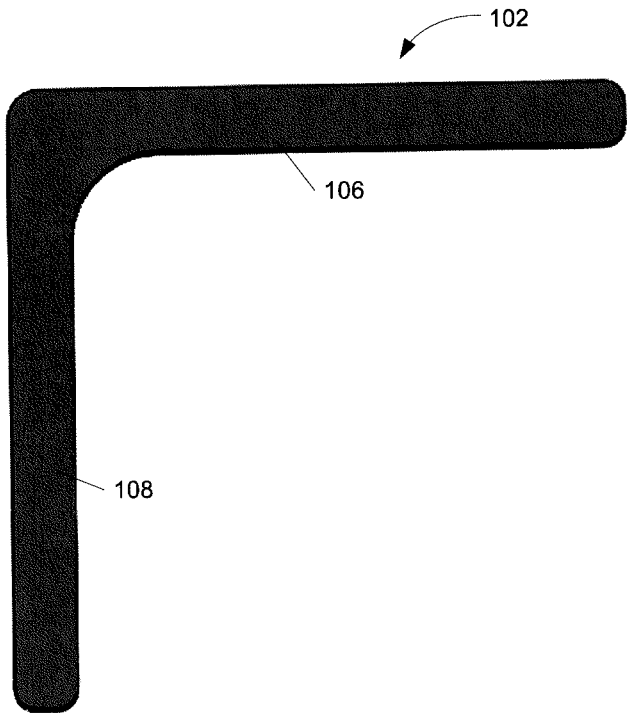
FIG. 3 is a profile view of the crossarm of FIG. 1.

Crossarm 102 may be a contiguous structure and may, as shown in FIG. 3, have a rounded or slightly curved interior surface. In some instances, this rounded interior surface may aid in the insertion of the crossarm 102 into an opening on the mounting base 104. Alternatively, crossarm 102 may be a discontiguous structure formed by connecting separate sections 106 and 108 together with fasteners or adhesives to create the generally L-shaped geometry of the crossarm. Even when fasteners or adhesives are used to connect separate sections 106 and 108 of a crossarm, the final crossarm may still have a rounded interior surface. As described in more detail below, the crossarm 102 may be suitably secured to the mounting base 104 with a fastening element.

Figure 4:
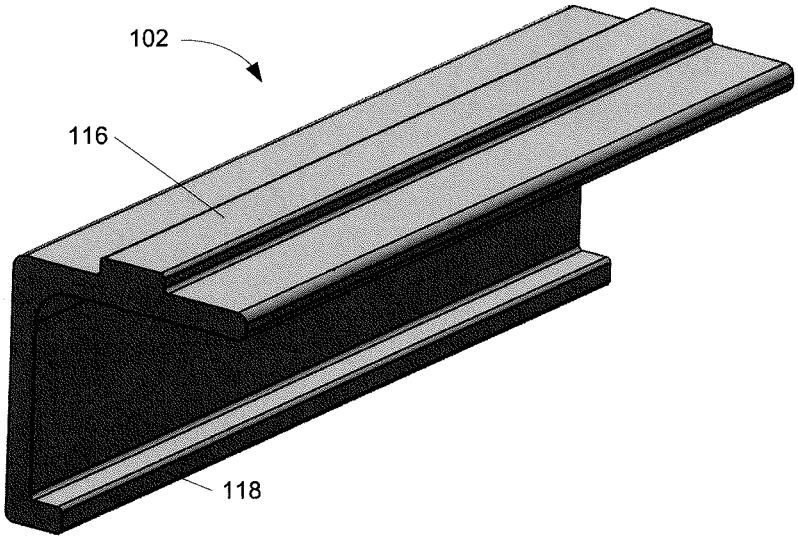
FIG. 4 is a perspective view of a crossarm in accordance with the present disclosure.

Crossarm 102 may include reinforcement portions to help crossarm 102 resist torsion and/or bending. FIG. 4 shows a non-limiting exemplary embodiment of crossarm 102 with a reinforcing rib 116 located on the exterior of first section 106 and reinforcing tab 118 on an interior edge of second section 108. As shown in FIG. 4, the reinforcement tab 118 extends from a distal end of the second section 108 along the interior edge. The reinforcement portions may resist torsion and/or bending by affecting the moment of inertia of the crossarm. The reinforcement portions may take any form that improves the resistance to torsion and/or bending, such as ribs, tabs, splines, dimples, or ridges. The reinforcement portions may be located anywhere on the crossarm and may be added during formation of the crossarm or as part of post-formation processing.

One or more attachment assemblies (not shown) may be used to secure suspended power lines or insulators to crossarm 102. In some embodiments, an attachment assembly may be one or more hardware plates, clasping members, and fastening devices that are used with existing utility poles. As a result, a crossarm in accordance with the disclosed embodiments may be backwards compatible with existing hardware. Alternatively, new attachment assemblies configured for use with the generally L-Shaped geometry of crossarm 102 or configured to mount to separately to sections 106 or 108 could also be used to secure suspended power lines or insulators to crossarm 102.

The length of crossarm 102 may be customized depending on use. In some instances, crossarm 102 may have a length-width footprint of approximately three feet by four feet. A crossarm 102 with these approximate dimensions may also be lightweight, weighing approximately 10 pounds to approximately 15 pounds. However, in other instances and depending on a particular need, crossarm 102 may have a longer/shorter and/or wider/thinner length-width footprint. As the footprint of crossarm 102 changes, so would the approximate weight of each crossarm. The lightweight nature of crossarm 102, however, is advantageous for ease of transportation, and during installation or removal of the crossarm and system. The generally L-shaped geometry of crossarm 102 also provides for easy packaging and storing, as multiple crossarms can be aligned in a similar orientation in order that they may be stacked together.

Crossarm 102 may be adapted for multiple different uses. Where an existing utility pole crossarm has degraded, crossarm 102 and mounting base 104 may be used as a replacement. Alternatively, crossarm 102 and mounting base 104 may also be used for new installations.

Figure 5:
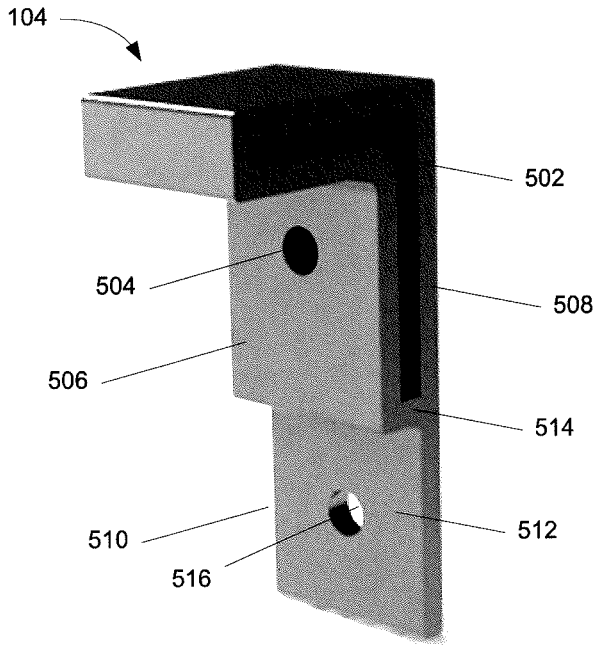
FIG. 5 is a perspective view of the mounting base of FIG. 1.

FIG. 5 is a perspective view of mounting base 104. Mounting base 104 includes an opening 502 that is complementary in shape to a cross-sectional profile of crossarm 102, and therefore configured to receive crossarm 102. Crossarm 102 may be aligned with opening 502 of mounting base 104 and slid through opening 502 until a desired position of mounting base 104 is reached. Crossarm fastening hole 504 may be used to hold crossarm 102 in place within mounting bracket 104. Opening 502 may be formed between a front-facing fastening surface 506 and a rear-facing surface 508. In some embodiments, crossarm fastening hole 504 may extend through the entirety of the front-facing fastening surface 506, but not through the rear-facing surface 508. The crossarm fastening hole 504 may be configured (e.g., sized, shaped, and positioned) to receive a fastener (not shown). The fastener may be a screw, bolt, wedge, anchor, pin, hook, or other suitable device. When the fastener is threaded, the crossarm fastening hole 504 may include corresponding mating threads. When mounting base 104 only includes a crossarm fastening hole 504 that extends through a front-facing fastening surface 506, crossarm 102 may be fixed within the mounting base 104 by inserting or tightening the fastener through the crossarm fastening hole 504 such that the fastener exerts a force against the a portion of section 108 of a crossarm 102 and an interior surface the rear-facing surface 508.

Although FIG. 5 depicts mounting base 104 with a crossarm fastening hole 504 that extends only through the entirety of the front-facing fastening surface 506, it is contemplated that a corresponding and mating rear-crossarm fastening hole can be formed in rear-facing surface 508. In this configuration, crossarm fastening hole 504 and rear-crossarm fastening hole would share similar sizes, shapes, and, depending on the configuration, threadings, and be aligned along a common axis. In this configuration, crossarm 102 may be fixed within mounting base 104 by inserting a fastener (as described above) through crossarm fastening hole 504, crossarm 102, and rear-crossarm fastening hole. During installation of the crossarm 102 and mounting base 104 to a utility pole, the fastener could also be secured into a mounting surface, such as a utility pole, thereby providing added support to prevent the mounting base 104 and crossarm 102 from moving over time. Preparation of the fastener through the crossarm fastening hole 504, crossarm 102, and rear-crossarm fastening hole could be done in advance of or during installation of the system to a mounting surface. It is further contemplated that crossarm 102 could include a hole that would receive the fastener and that would align with the crossarm fastening hole 504 and rear-crossarm fastening hole.

Mounting base 104 may also be configured with a mounting section 510. Mounting section 510 may be an extension of the rear-facing surface 508, such that the rear surface of mounting section 510 and rear-facing surface 508 are aligned along a similar plane. As shown in FIG. 5, a front surface 512 of mounting section 510 may be setback from front-facing fastening surface 506. That is the front-facing fastening surface 506 may extend over less that an entire portion of the height of the rear-facing surface 508. A support 514 may connect front-facing fastening surface 506 and an inner portion of rear-facing surface 508. Support 514 may extend through an entire width of the mounting base, and may hold a portion of crossarm 102 when crossarm 102 has been inserted through opening 502.

A mounting hole 516 is formed in mounting section 510. Mounting hole 516 may extend through the entirety of mounting section 510. The mounting hole 516 may be configured (e.g., sized, shaped, and positioned) to receive a mounting fastener (not shown). The mounting fastener may be a screw, bolt, wedge, anchor, pin, hook, or other suitable device. When the mounting fastener is threaded, the mounter hole 516 may include corresponding mating threads.

During the fabrication process, opening 502 may be created by any of a number of cutting techniques, such as plasma cutting, laser cutting, waterjet cutting, or any other suitable method for creating opening 502.

Figure 6:
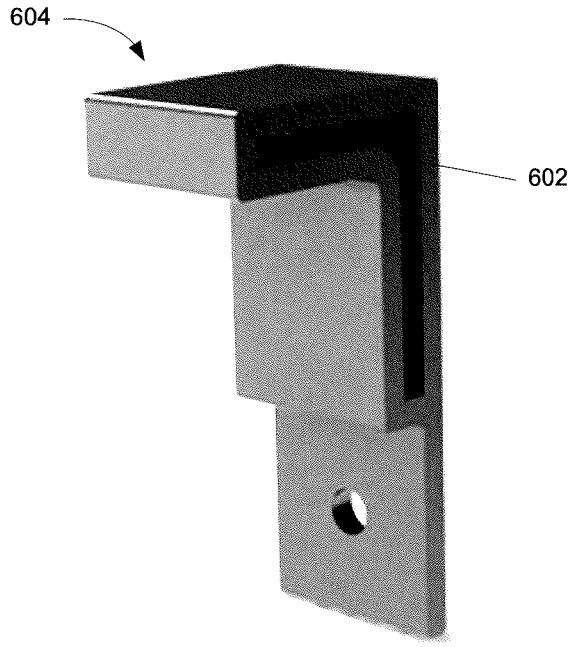
FIG. 6 is a perspective view of an alternate mounting base for use with separate crossarms.
Figure 7:
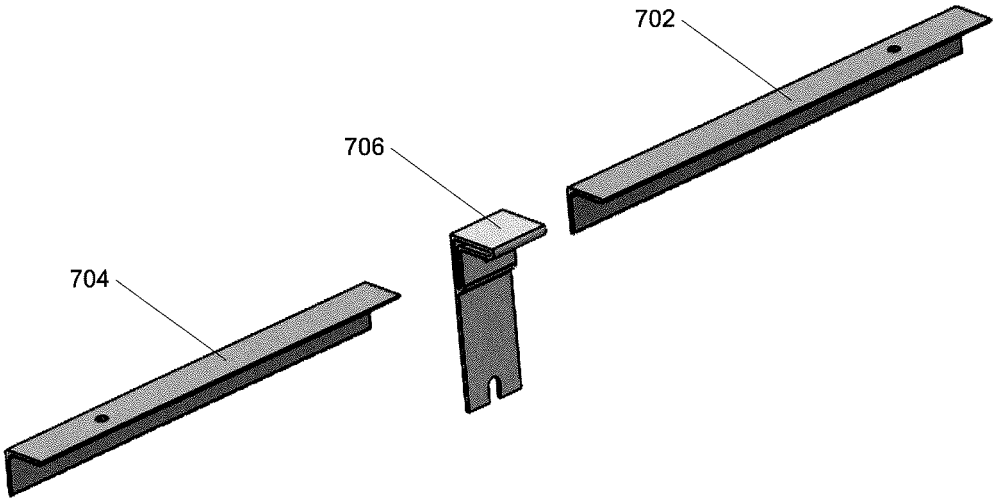
FIG. 7 is an exploded view of a system with two crossarms and a mounting base in accordance with the present disclosure.

In a second embodiment of an L-shaped crossarm and mounting base system, a mounting base 604 may be configured without a crossarm fastening hole, as shown in FIG. 6. In such an embodiment, one or more mounting clasps (not shown) may be positioned within opening 602. Smaller crossarms may be used in connection with mounting base 604. Rather than sliding a crossarm through the entirety of the opening 602, an edge of a first crossarm may be inserted through a first side of opening 602. An internal abutment or stop positioned at or near the middle of opening 602 along the width of mounting base 604 may prevent the first crossarm from being inserted any further than midway through opening 602, and may cause a first retaining assembly to retain the first crossarm in place. A second crossarm could be inserted into the opposite side of mounting base 604 through an opening opposite 602. The second crossarm could be inserted until the internal abutment or stop is reaching, causing a second retaining assembly to retain the second crossarm in place. For example, FIG. 7 shows an exploded view of two crossarms 702, 704 that can be inserted into a mounting base 706. Each mounting assembly may include one or more springs or a retaining mechanism, such as lip, ram, or biased tabs that will exert a force on the inserted crossarm to retain it in place within mounting base 604. In some configurations, a quick release button or latch may be provided on an exterior portion of the mounting base 604. Actuating the quick release button or latch may cause an associated retaining assembly to release a crossarm. In such configurations, one quick release button or latch could cause all retaining assemblies to release, but other configurations could have separate quick release buttons or latches so individual crossarms at different times. Use of the mounting assemblies and quick release buttons or latches may be advantageous when it comes to replacing or decommissioning a crossarm.

In some embodiments, mounting base 604, may include self-leveling springs within its openings (602 and corresponding opening on the opposite side of mounting base 604). The self-leveling springs may cause the separately inserted crossarms to level to an approximately horizontal plane even though mounting base 604 may not have been positioned at a horizontal plane when fixed to a mounting surface.

Figure 8:
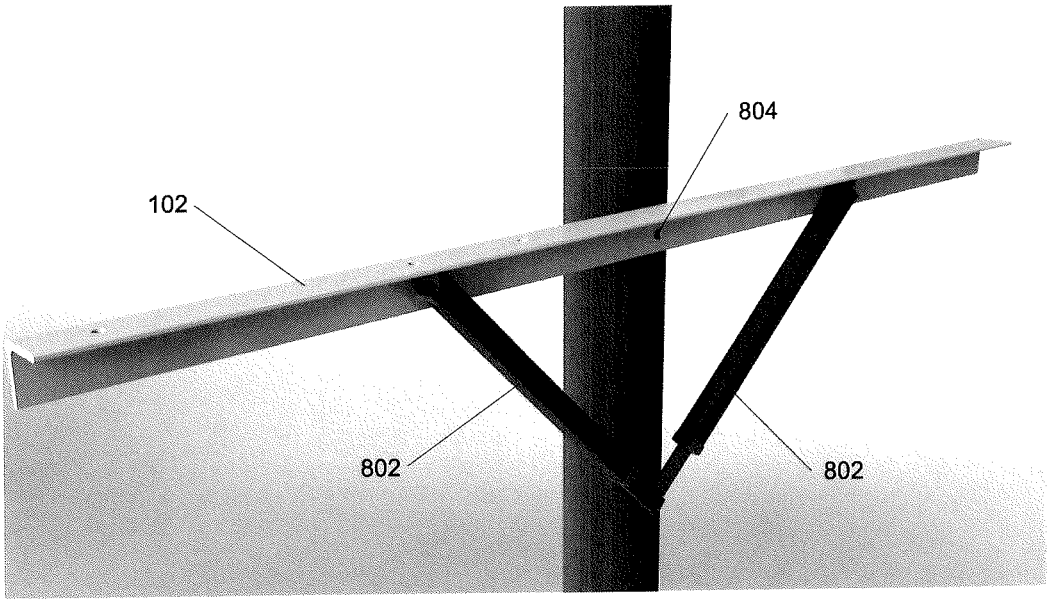
FIG. 8 is a perspective view of a crossarm and detachable braces in accordance with the present disclosure.

Some embodiments of crossarm 102 may be attached to a structure, such as a utility pole, without a mounting base. FIG. 8 shows crossarm 102 attached to a utility pole through detachable braces 802. In FIG. 8, crossarm 102 may be attached directly to the utility pole through hole 804 with a fastener and also attached to the utility pole through detachable braces 802. The fastener may be a screw, bolt, wedge, anchor, pin, hook, or other suitable device. When the fastener is threaded, the hole 804 may include corresponding mating threads. Alternatively, crossarm 102 may be attached to a structure using both a mounting base and detachable braces. The attachment assemblies to secure suspended power lines or insulators to crossarm 102 may be secured to attachment apertures, as show in FIG. 8.

Figure 10:
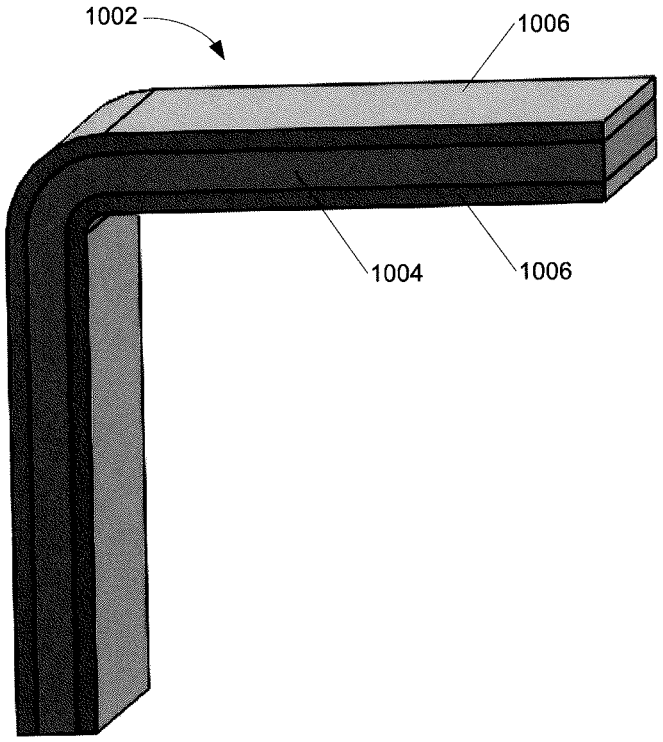
FIG. 10 is a perspective view of a crossarm in accordance with the present disclosure.

Although specific embodiments have been described with a crossarm having a composite material that may be a reinforced plastic formed by drawing resin-coated glass fibers through a heated die, such as a pultruded fiberglass, crossarms created by other processes and composite materials made be used within the scope of the present disclosure. For example, in another embodiment, the crossarm composite material may be a fiberglass created from an alternate forming process. Such alternate processes may exclude the use of a mandrel to form the fiberglass. Excluding the use of a mandrel may form a fiberglass crossarm without interior cavities, which may improve the strength and durability of the crossarm. In yet other embodiments, the crossarm composite material may be an armed fiber material or a polyester fiber material. In still yet other embodiments, crossarm composite material may be created utilizing multiple mat layers of material that are bonded together for strength and stability. For example, FIG. 9 shows a crossarm 902 with an I-beam shaped cross-section. Crossarm 902 is composed of a sandwich structure such that an inner material 904 is located between layers of outer material 906. The outer material 906 may be a reinforced plastic composite, as previously discussed. The inner material 904 may be a lightweighting structure, such as a structural foam or honeycomb material, that is lighter weight than the outer material 906. The use of a lightweighting structure will reduce the overall weight of the crossarm 902 and may also reduce its cost. FIG. 10 shows another example embodiment of a crossarm 1002 composed of a sandwich structure with inner material 1004 and outer material 1006. The sandwich structures may include multiple layers of lightweighting structure and reinforced plastic composite in any order or any amount of layers. For example, FIG. 9 shows two adjacent layers of lightweighting structure sandwiched between outer layers of reinforced plastic composite.

Additionally, it is contemplated that alternative configurations of the mounting base are within the scope of the present disclosure. For example, in another embodiment, a mounting base of the types described in FIGS. 1, 5, 6 and 7 could have a rear-facing surface that includes a curvature that complements the shape of a curved mounting surface, such as a utility pole. Additionally, a mounting base of the types described in FIGS. 1, 5, 6 and 7 could have a sandwich structure, as described in relation to FIGS. 9 and 10.

Specific embodiments have been described for the purpose of illustrating the manner in which the aspects of the present disclosure are user. It should be understood that the implementation of other variations and modifications of the embodiments described herein and their various aspects will be apparent to one skilled in the art, and that the invention is not limited by the specific embodiments described herein.

We claim:

1. A crossarm for power transmission systems, the crossarm comprising:

an arm extending in a longitudinal direction and having a generally uniform cross-section formed of a first section and a second section, wherein the first section and the second section are coupled together and are oriented perpendicularly to each other, wherein at least one of the first or second section has a reinforcement tab extending from a distal end along an interior edge toward the other of the first or second section to improve resistance to torsion or bending of the arm, at least one mounting hole formed on one of the first and second sections for mounting the arm to a utility structure; and a plurality of power line attachment apertures formed arm along the other of the first or second sections than the mounting hole for securing a power line or an insulator to the arm, wherein the arm is composed of a composite material that contains a plurality of fibers extending in the longitudinal direction within the composite material.

2. The crossarm of claim 1, wherein the plurality of fibers extend along an entire length in the longitudinal direction of the arm.

3. The crossarm of claim 1, wherein the plurality of fibers do not extend along an entire length in the longitudinal direction of the arm.

4. The crossarm of claim 1, wherein at least a portion of the arm is formed as a sandwich structure having the composite material and a second material.

5. The crossarm of claim 4, wherein the sandwich structure has alternating layers of the composite material and the second material being lighter weight than the composite material.

6. The crossarm of claim 4, wherein the second material comprises structural foam or honeycomb material.

7. The crossarm of claim 1, further comprising a reinforcement rib extending from one of the first or second sections, wherein the reinforcement rib improves resistance to torsion or bending of the arm.

8. The crossarm of claim 1, wherein the first section and second section are formed separately and are connected together to form the arm.

9. The crossarm of claim 1, wherein the first section and second section are coupled in at least one of a generally L-shaped geometry, I-beam shaped geometry, or a T-beam shaped geometry.

10. The crossarm of claim 1, further comprising a second reinforcement tab extending from a distal end of the other of the first or second section, the second reinforcement tab extending toward the first reinforcement tab.

11. The crossarm of claim 1, further comprising:

a mat material covering the plurality of fibers along an exterior edge of the first and second sections; and an outer coating covering the mat material.

12. A crossarm for power transmission systems, the crossarm comprising:

an arm extending in a longitudinal direction and having a generally uniform cross-section formed of a first section and a second section extending generally perpendicularly to the first section, wherein at least one of the first or second section has a reinforcement portion extending from a distal end to improve resistance to torsion or bending of the arm;

wherein the arm is formed of a composite material having a plurality of fibers extending in the longitudinal direction.

13. The crossarm of claim 12, further comprising:

at least one mounting hole formed on one of the first and second sections for mounting the arm to a utility structure; and a plurality of power line attachment apertures formed arm along the other of the first or second sections than the mounting hole for securing a power line or an insulator to the crossarm.

14. The crossarm of claim 13, further comprising a plurality of power line attachment assemblies coupled to the arm adapted to secure one of a power line or an insulator to the crossarm.

15. The crossarm of claim 12, further comprising a second reinforcement portion extending from the other of the first and second section.

16. The crossarm of claim 12, wherein the reinforcement portion extends from a distal end of the first or second section along an interior edge towards the other of the first or second section.

17. The crossarm of claim 12, further comprising:

a mat material covering the plurality of fibers along an exterior edge of the first and second sections; and an outer coating covering the mat material.

18. A crossarm for power transmission systems, the crossarm comprising:

an arm extending in a longitudinal direction and formed of a composite material having a plurality of fibers extending in the longitudinal direction within the composite material, the arm having a generally uniform cross-section formed of:

an upper section for securing a power line or an insulator to the arm; and a lower section extending transverse to the upper section for mounting the arm to a utility structure;

wherein at least one of the upper or lower section has a reinforcement tab extending from a distal end to improve resistance to torsion or bending of the arm.

19. The crossarm of claim 18, wherein the reinforcement tab extends from the distal end of the upper or lower section along an interior edge towards the other of the upper or lower section.

20. The crossarm of claim 18, further comprising a second reinforcement tab extending from the other of the upper or lower section.

* * * * *